US010213677B1

(12) United States Patent
Hirshberg

(10) Patent No.: US 10,213,677 B1
(45) Date of Patent: Feb. 26, 2019

(54) MOUTHGUARD WITH FLAVORED RESIN EMBEDDED WITHIN THE MOUTHGUARD

(71) Applicant: Jonathan S. Hirshberg, Manhattan Beach, CA (US)

(72) Inventor: Jonathan S. Hirshberg, Manhattan Beach, CA (US)

( * ) Notice: Subject to any disclaimer, the term of this patent is extended or adjusted under 35 U.S.C. 154(b) by 446 days.

(21) Appl. No.: 14/935,220

(22) Filed: Nov. 6, 2015

Related U.S. Application Data

(63) Continuation-in-part of application No. 29/502,114, filed on Sep. 11, 2014, now Pat. No. Des. 743,107.

(51) Int. Cl.
*A63B 71/08* (2006.01)

(52) U.S. Cl.
CPC ..... *A63B 71/085* (2013.01); *A63B 2071/086* (2013.01)

(58) Field of Classification Search
CPC ..... A61F 5/566; A61F 5/56; A61F 2005/563; A61F 5/58; A61C 7/08; A61C 19/063; A63B 71/085; A63B 2071/086; A63B 2017/088; A61B 5/4547; A61B 5/4552; A61B 5/4557; A61B 5/682; A61B 5/0534
See application file for complete search history.

(56) References Cited

U.S. PATENT DOCUMENTS 4,537,689 A * 8/1985 Morrow ..... A61K 8/02 508/143
6,109,266 A * 8/2000 Turchetti ..... A63B 71/085 128/861
2006/0130851 A1* 6/2006 Mathias ..... A61F 5/566 128/861
2008/0257358 A1* 10/2008 Stern ..... A61F 5/566 128/207.16
2016/0001160 A1* 1/2016 Engel ..... A63B 71/085 128/861

* cited by examiner

*Primary Examiner* — Tarla R Patel
(74) *Attorney, Agent, or Firm* — Thomas I. Rozsa

(57) ABSTRACT

A mouthguard which has a unique shape and design which not only facilitates air passages so a player can breath while the mouthguard is in the player's mouth and protecting the player's teeth, but also has additionally has a flavoring embedded within the mouthguard, preferably on the base on which the player is placing his upper row of teeth so that in addition to protection, the mouthguard has an attractive flavor which can be tasted by the player as the player bites down on the mouthguard.

2 Claims, 7 Drawing Sheets

MOUTHGUARD WITH FLAVORED RESIN EMBEDDED WITHIN THE MOUTHGUARD

CROSS-REFERENCE TO RELATED APPLICATION

This patent application is a continuation-in-part of Design patent application No. 29/502,114 filed on Sep. 11, 2014, now pending.

The following utility patent application contains the same embodiment as the co-pending design patent application and only adds to it flavoring within certain portions of the body of the mouthguard and it is therefore respectfully submitted that this utility patent application is acceptable for filing as a continuation-in-part of the co-pending design patent application under 35 U.S.C. § 120.

BACKGROUND OF THE INVENTION

1. Field of the Invention

The present invention relates to the field of devices which protect an athlete's teeth while the athlete is engaged in a sporting activity such as playing football.

2. Description of the Prior Art

In general, there are many devices known in the prior art which are used to protect an athlete or a person while the athlete or person is engaged in a sporting activity. In one sporting activity such as football, the person engaged in playing football wears many protective devices to protect various body parts of the person such as shoulder pads, leg guards, and a helmet which has bars in front to protect the person's face during physical contact while playing football.

One of the most sensitive parts of a person's body are the person's teeth. There frequently are violent collisions between persons engaged in the game of football, such as a running back being tackled by a defensive player or a wide receiver being hit by a defensive player. During these collisions, it is very easy for one or more teeth to be knocked out or otherwise damaged such as being chipped or cracked. To help protect teeth and reduce the occurrence of damage to teeth, devices such as mouthguards have been developed. In the prior art, one type of mouthguard is a dental tray which is conformed to the shaped of a person's upper teeth and is worn in the mouth to protect the upper teeth. The mouthguard rests against the person's lower teeth to also protect the person's lower teeth.

In addition to functionality, a mouthguard is often attractive to athletes because of its attractive design. There is a significant need for a mouthguard that has both an attractive design for its shape and also provides additional embellishments to enhance the desirability of the mouthguard for use by athletes.

SUMMARY OF THE INVENTION

The present invention is a mouthguard which has a unique shape and design which not only facilitates air passages so a player can breath while the mouthguard is in the player's mouth and protecting the player's teeth, but also additionally has a flavoring embedded within the mouthguard, preferably on the base on which the player is placing his teeth so that in addition to protection, the mouthguard has an attractive flavor which can be tasted by the player as the player bites down on the mouthguard.

Therefore, it is an object of the present invention to provide a mouthguard that is aesthetically appealing and also has the function of being able to have a flavoring within the mouthguard to enable a user to have an attractive taste in the person's mouth while at the same time providing protection to the person's teeth and also providing an air passage to enable the person to breathe while having the mouthguard in the person's mouth.

Defined in detail, the present invention is an apparatus comprising: (a) a mouthguard having a shape as illustrated in FIGS. 1, 2, 3, 4, 5, 6, 7 and 8; (b) the mouthguard including a right exterior sidewall and a right interior sidewall on opposite sides of a right teeth supporting base, a middle exterior wall and a middle interior wall on either side of a middle teeth supporting base, and a left exterior sidewall and a left interior sidewall on either side of a left teeth supporting base, the mouthguard further comprising an extension portion having a multiplicity of breathing openings extending from a front of the extension portion through the middle interior wall; and (c) a flavored resin embedded within the right teeth supporting base, the middle teeth supporting base and the left teeth supporting base; (d) whereby the flavored resin enters a person's mouth when the person's upper row pf teeth rest upon the right teeth supporting base, the center teeth supporting base and the left teeth supporting base. The mouthguard also includes at least one breathing opening in the middle exterior wall and at least one breathing opening in the right exterior sidewall and at least one breathing opening in the left exterior sidewall.

Defined more broadly, the present invention is an apparatus comprising: (a) a mouthguard having a shape as illustrated in FIGS. 1, 2, 3, 4, 5, 6, 7 and 8; (b) the mouthguard including a right exterior sidewall and a right interior sidewall on opposite sides of a right teeth supporting base, a middle exterior wall and a middle interior wall on either side of a middle teeth supporting base, and a left exterior sidewall and a left interior sidewall on either side of a left teeth supporting base; and (c) a flavored resin embedded within the right teeth supporting base, the middle teeth supporting base and the left teeth supporting base. The present invention also includes at least one breathing opening in the middle exterior wall and at least one breathing opening in the right exterior sidewall and at least one breathing opening in the left exterior sidewall.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Figure 1:
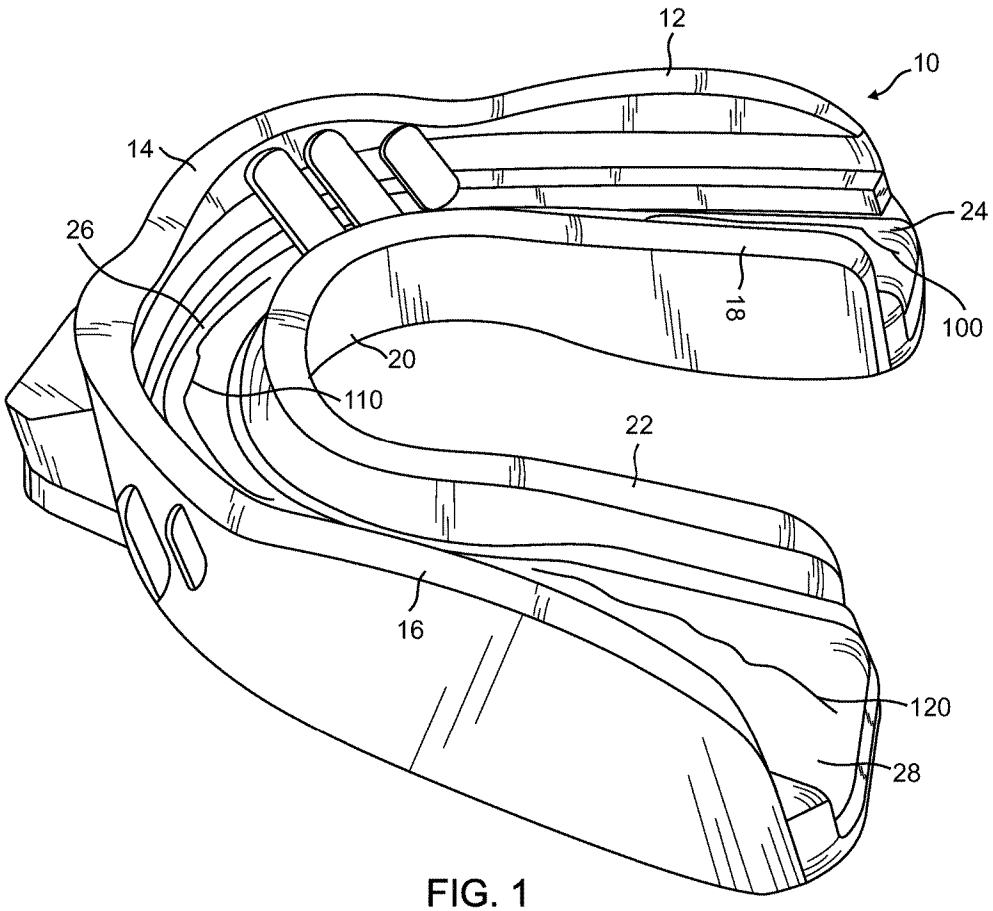
FIG. 1 is a top perspective view of the mouthguard with flavored resin embedded within the mouthguard and also incorporating the attractive design of the mouthguard.
Figure 2:
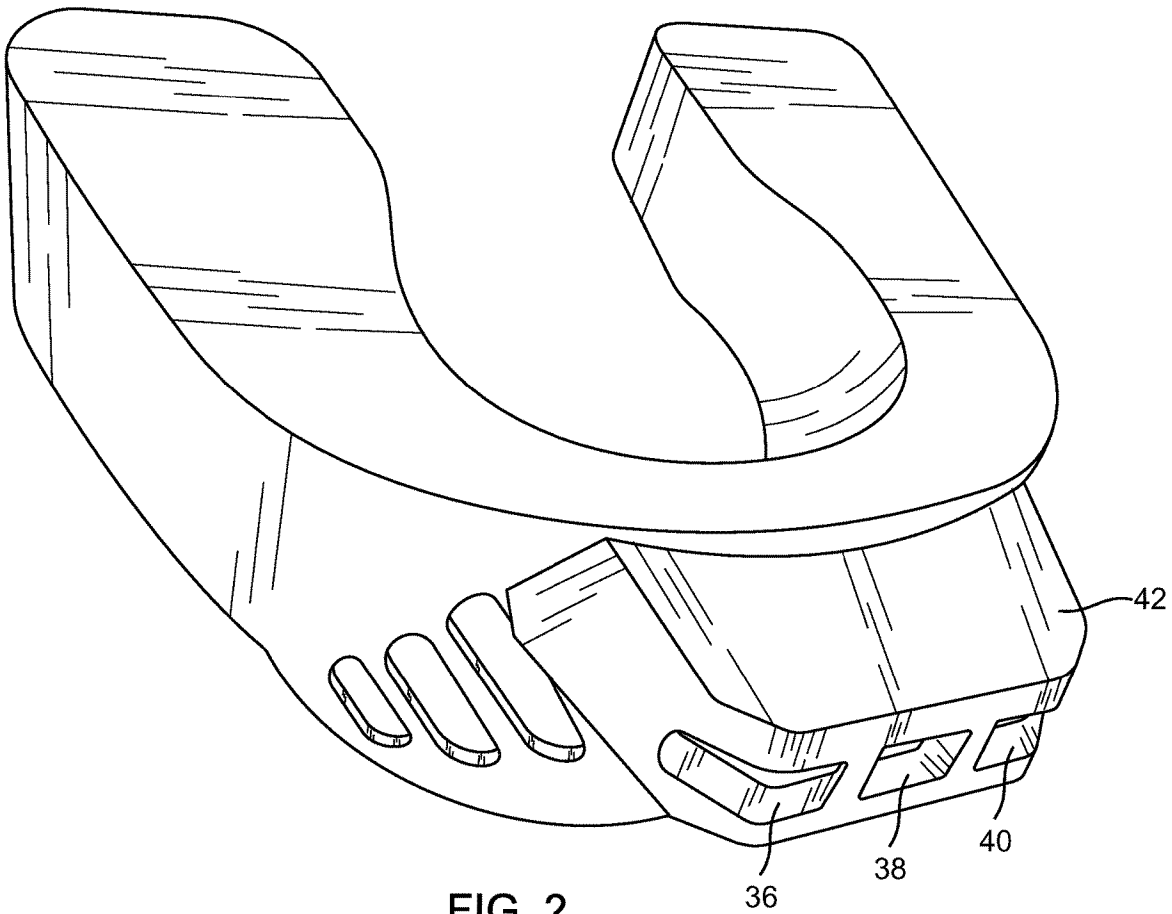
FIG. 2 is a bottom perspective view of the present invention mouthguard.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention mouthguard is protectable because of its unique design. Features of the mouthguard that are illustrated are for purposes of reference to the components of the mouthguard but it is emphasized that it is the shape of the mouthguard that is protectable. The embedded flavored resin is visible only in FIGS. 1 and 3.

Referring to FIGS. 1-8, there is illustrated the present invention uniquely designed mouthguard with flavored resin embedded within the mouthguard. It is emphasized that it is the shape and appearance of the mouthguard that is the unique feature of the present invention that has been protected with a design patent by the present inventor. The components are ancillary to the design but the additional feature in the present application is the creation of flavored resin 100 embedded within the base 24, 26, 28 onto which a user places his upper row of teeth and when the user bites down on the mouthguard, the teeth come in contact with the bases containing the flavored resin 100 so that the flavored resin goes into the person's mouth. A person's lower teeth rests against respective lower surfaces 30, 32 and 34.

The present invention mouthguard with flavored resin embedded within the mouthguard 10 is illustrated in FIGS. 1-8. Looking at the mouthguard as if it were placed in a person's mouth for the purpose of determining right and left, the mouthguard has a right exterior sidewall 12, a center exterior sidewall 14 and a left exterior sidewall 16, a right interior sidewall 18, a middle interior sidewall 20 and a left interior sidewall 22. The mouthguard has teeth supporting bases which include a right teeth supporting base 24, a middle teeth supporting base 26 and a left teeth supporting base 28. The mouthguard's functionality is that it includes a multiplicity of breathing openings through an extended portion 42 which has three spaced apart breathing openings 36, 38 and 40 which extend through the entire distance of the front breathing section 42 and opens at the corresponding center interior wall 20 so that there is a breathing passage from the front exterior section 42 of the mouthguard with breathing openings 40, 38 and 36 extending through the entire passage and opening within the interior center wall 20 so that a person can breathe while having the person's upper row of teeth 240 resting on the interior teeth supporting tray sections 24, 26 and 28 and the person's lower row of teeth rest against respective lower base sections 30, 32 and 34.

Figure 7:
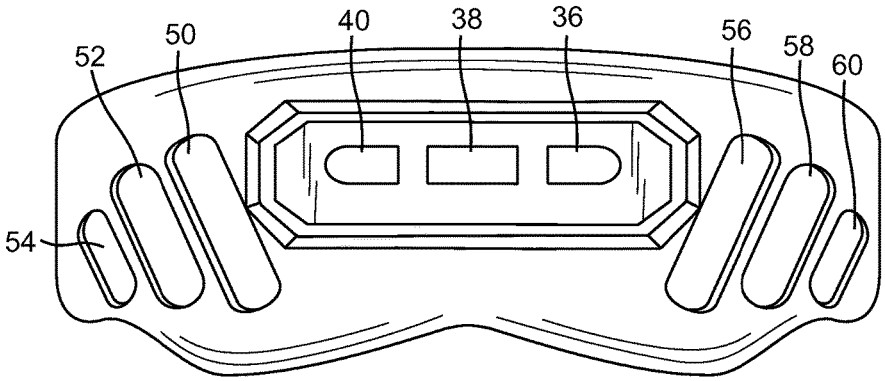
FIG. 7 is a front view of the present invention mouthguard.
Figure 8:
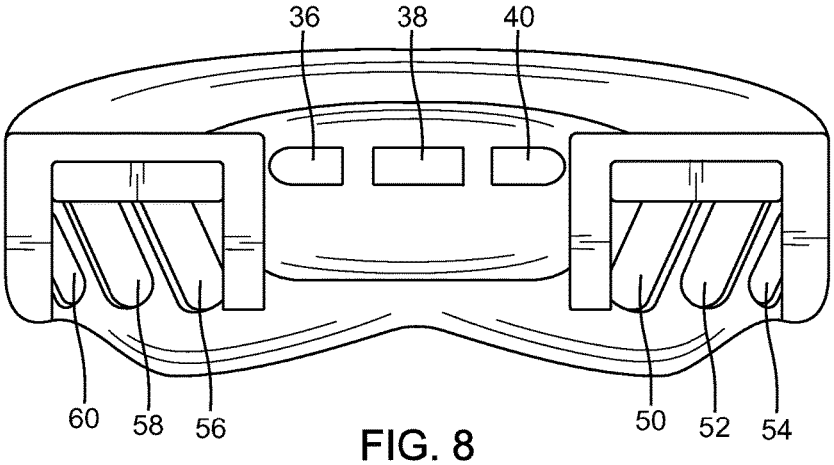
FIG. 8 is a rear view of the present invention mouthguard.

Also, there are side breathing openings extending through the entire thickness on opposite sides of the exterior front wall 14 which include exterior breathing openings 50, 52 and 54 located on the exterior front wall 14 adjacent the left exterior sidewall and partially extending into the left exterior sidewall 16 and breathing openings 56, 58 and 60 located onto the exterior front wall 14 and extending to the right exterior sidewall 12 as best illustrated in FIGS. 7 and 8.

Figure 3:
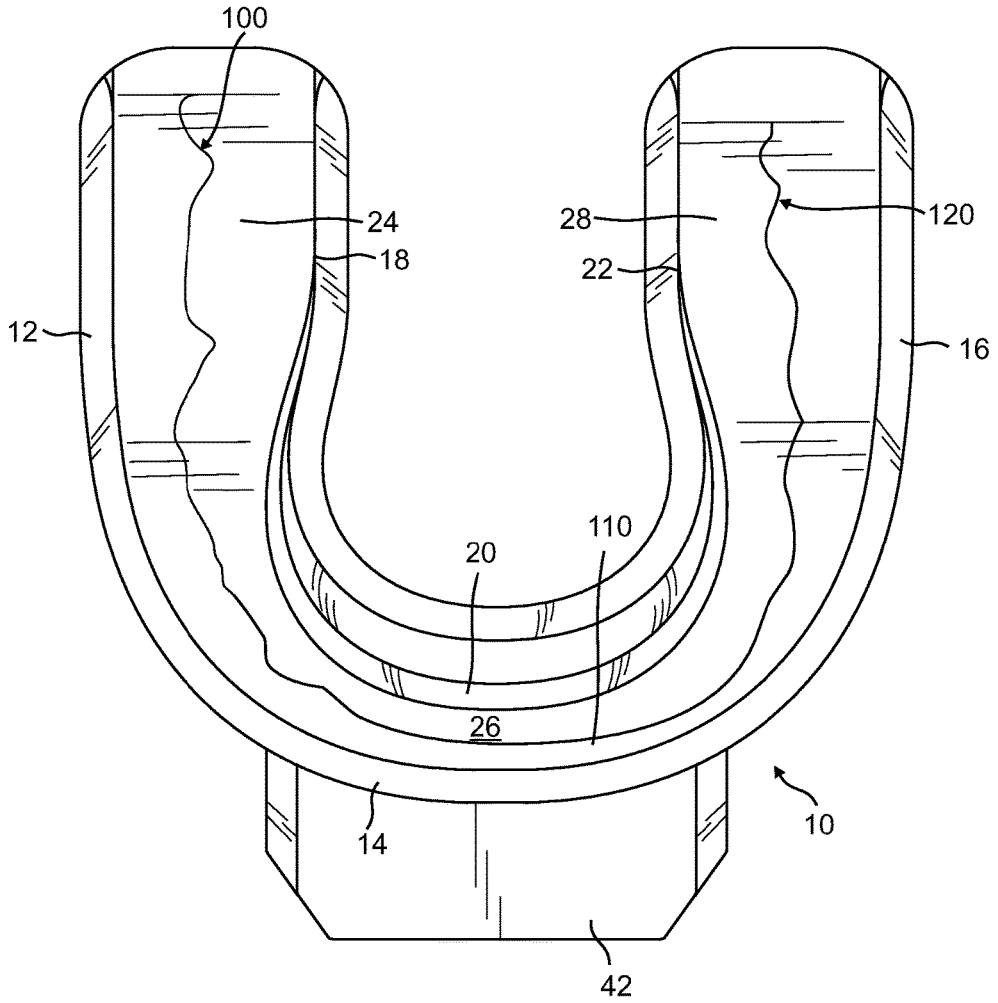
FIG. 3 is a top plan view of the present invention mouthguard illustrating the flavored resin embedded within the mouthguard.
Figure 4:
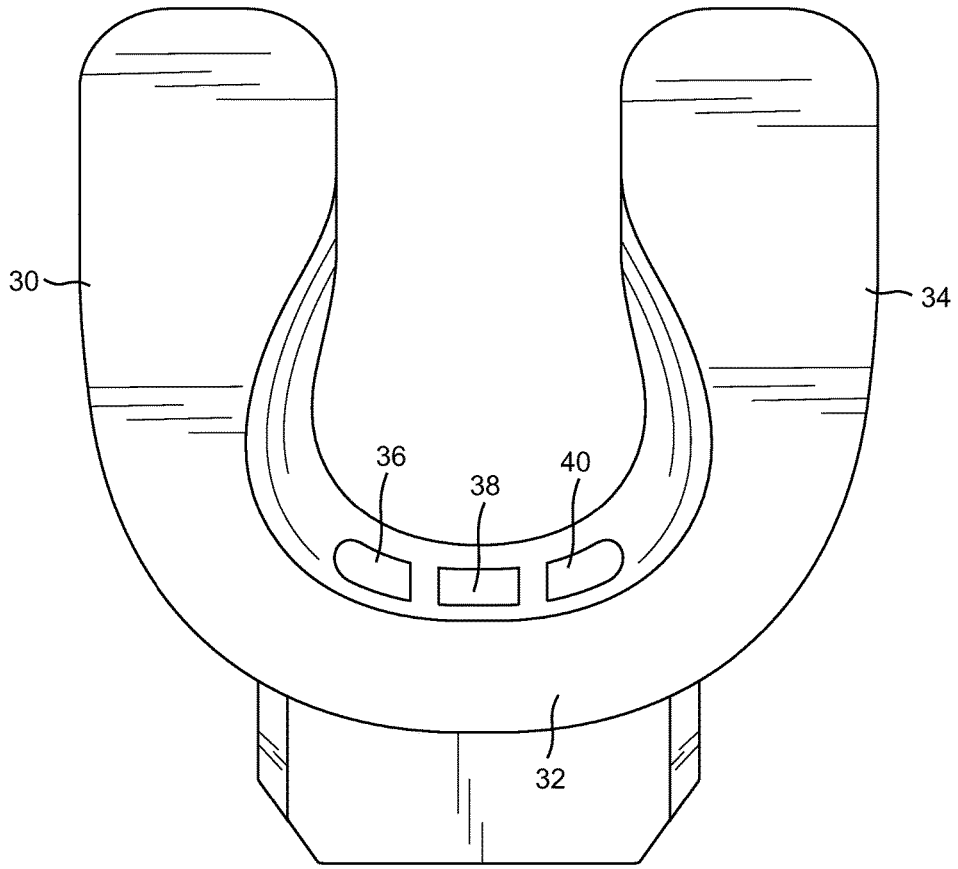
FIG. 4 is a bottom plan view of the present invention mouthguard.
Figure 5:
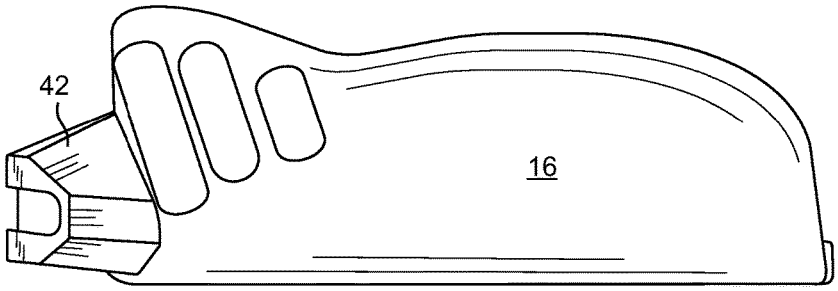
FIG. 5 is a left side elevational view of the present invention mouthguard.
Figure 6:
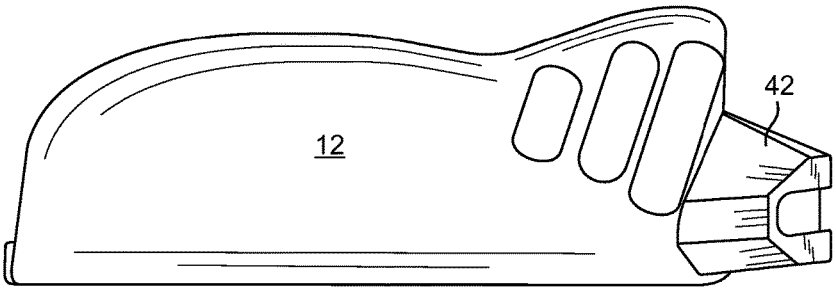
FIG. 6 is a right side elevational view of the present invention mouthguard.
Figure 9:
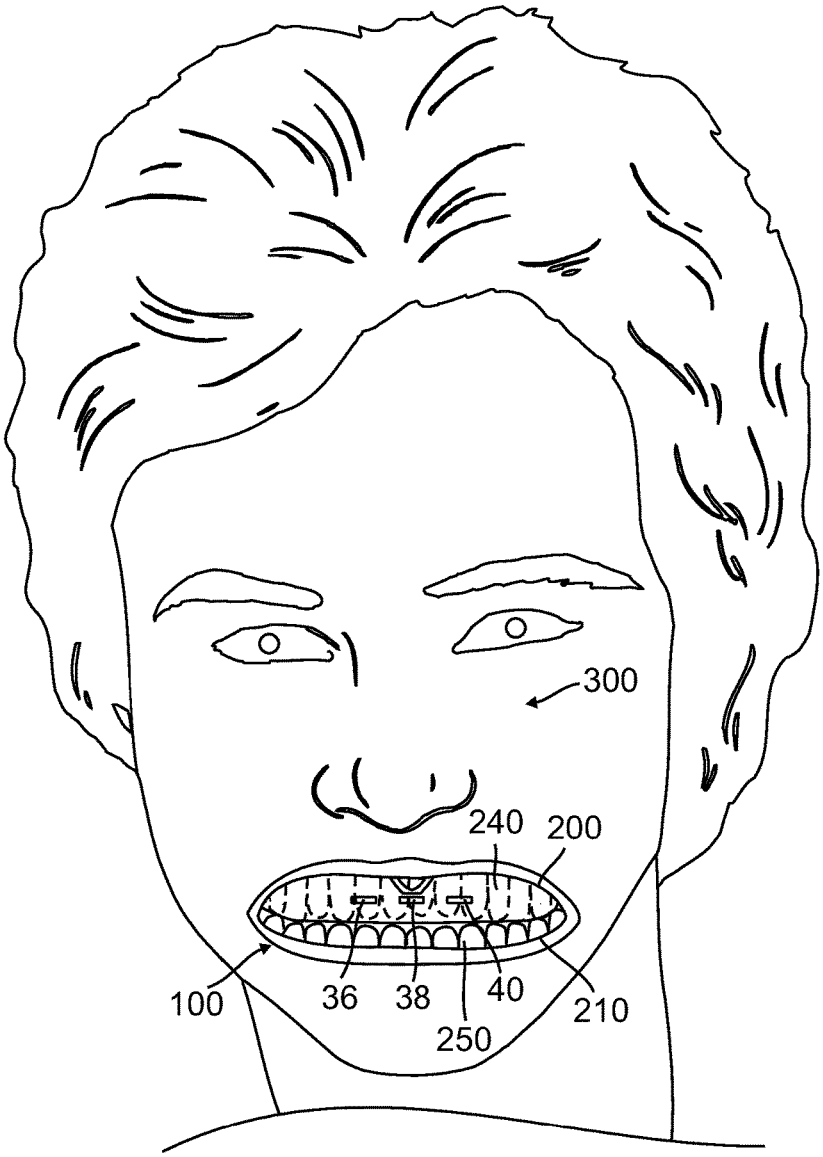
FIG. 9 is an illustration showing the present invention mouthguard placed in a person's mouth with the forward section extending forwardly of the person's lips to enable breathing.

Referring to FIGS. 1 and 3, interior right teeth supporting base section 24 has a flavored resin 100 embedded within, the center teeth base supporting section 26 has a flavored resin 110 embedded within and the left teeth supporting base section 28 has a flavored resin 120 embedded within. When a person places the person's teeth in the mouthguard as illustrated in FIG. 9, the upper row of teeth 240 (shown in dashed lines) rest on the teeth supporting bases 24, 26 and 28. Flavored resin 100, 110 and 120 are respectively embedded throughout the bases 24, 26 and 28 so that when a person's teeth rest within the mouthguard, the upper teeth 240 (see FIG. 9) rest against the teeth supporting bases 24, 26 and 28 and in so doing, the flavored resin 100, 110, 120 respectively seep through the base walls 24, 26 and 28 and enter the person's breathing cavity and mouth so that the flavored resin is tasted by the person while having the mouthguard placed in the person's mouth.

FIG. 9 is an illustration showing the present invention mouthguard placed in a person's mouth with the forward section 42 extending forwardly of the person's lips to enable breathing. Referring to FIG. 9, there is illustrated a person's mouth 100, upper lip 200 and lower lip 210, with the mouthguard 10 retained in the person's mouth illustrating breathing openings 36, 38 and 40 in the mouthguard 10. The upper row of teeth 240 is illustrated in dashed lines and the lower row of teeth 250 rest against the underside of the mouthguard as previously described.

Therefore, through use of the present invention, the person's teeth are protected by the mouthguard having a unique shape and design and also having flavored resin embedded within the mouthguard base.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A mouthguard comprising:

a. a right exterior sidewall and a right interior sidewall on opposite sides of a right supporting base, a middle exterior wall and a middle interior wall having a middle supporting base between the middle exterior wall and the middle interior wall, and a left exterior sidewall and a left interior sidewall on either side of a left supporting base;

b. an extension portion incorporated into the middle exterior wall, the extension portion having a front surface, the extension portion having three spaced apart breathing openings, each respective breathing opening extending from the front surface of the extension portion to the middle interior wall;

c. three right spaced apart breathing openings, one right breathing opening located at the middle exterior wall and to the right of the extension portion and extending from the middle exterior wall to the middle interior wall, one right breathing opening located at the right exterior sidewall and extending from the right exterior sidewall to the right interior sidewall, and one right breathing opening at the intersection of the middle exterior wall and right exterior sidewall and extending from the middle exterior wall and right exterior sidewall to the middle interior wall and right interior sidewall;

d. three left spaced apart breathing openings, one left breathing opening located at the middle exterior wall and to the left of the extension portion and extending from the middle exterior wall to the middle interior wall, one left breathing opening located at the left exterior sidewall and extending from the left exterior sidewall to the left interior sidewall, and one left breathing opening at the intersection of the middle exterior wall and left exterior sidewall and extending from the middle exterior wall and left exterior sidewall to the middle interior wall and left interior sidewall; and e. a flavored resin embedded within the right supporting base, the middle supporting base and the left supporting base.

2. A mouthguard comprising:

a. a right exterior sidewall and a right interior sidewall on opposite sides of a right supporting base, a middle exterior wall and a middle interior wall having a middle supporting base between the middle exterior wall and the middle interior wall, and a left exterior sidewall and a left interior sidewall on either side of a left supporting base;

b. an extension portion incorporated into the middle exterior wall, the extension portion having a front surface, the extension portion having at least two spaced apart breathing openings, each respective breathing opening extending from the front surface of the extension portion to the middle interior wall;

c. at least two right spaced apart breathing openings, one right breathing opening located at the middle exterior wall and to the right of the extension portion and extending from the middle exterior wall to the middle interior wall, one right breathing opening located at the right exterior sidewall and extending from the right exterior sidewall to the right interior sidewall;

d. at least two left spaced apart breathing openings, one left breathing opening located at the middle exterior wall and to the left of the extension portion and extending from the middle exterior wall to the middle interior wall, and one left breathing opening located at the left exterior sidewall and extending from the left exterior sidewall to the left interior sidewall; and e. a flavored resin embedded within the right supporting base, the middle supporting base and the left supporting base.

* * * * *